US007228662B1

(12) United States Patent
John

(10) Patent No.: US 7,228,662 B1
(45) Date of Patent: Jun. 12, 2007

(54) REMOVABLE WINDOW INSULATOR

(76) Inventor: Gary K. John, 6054 Leprechaun La., Hartford, WI (US) 53027-9038

( * ) Notice: Subject to any disclaimer, the term of this patent is extended or adjusted under 35 U.S.C. 154(b) by 721 days.

(21) Appl. No.: 10/636,077

(22) Filed: Aug. 7, 2003

(51) Int. Cl.
*E06B 1/04* (2006.01)

(52) U.S. Cl. ..... 52/204.1; 52/212

(58) Field of Classification Search ..... 52/204.1, 52/204.71, 204.5, 213, 215, 786.13, 656.1, 52/656.2, 656.4, 656.5, 656.7, 656.9, 203, 52/202, 741.4, 745.15; 49/501
See application file for complete search history.

(56) References Cited

U.S. PATENT DOCUMENTS

| | | | | |
|---|---|---|---|---|
| 4,199,900 | A * | 4/1980 | Johnston et al. | 49/404 |
| 4,462,186 | A | 7/1984 | Fuller | 49/463 |
| 4,486,990 | A | 12/1984 | Bauch | 52/202 |
| 4,831,804 | A * | 5/1989 | Sayer | 52/475.1 |
| 5,887,391 | A * | 3/1999 | Shoup | 52/202 |
| 6,052,957 | A | 4/2000 | Minnich | 52/202 |
| 6,390,173 | B1 * | 5/2002 | Story, Jr. | 160/371 |
| 6,886,297 | B1 * | 5/2005 | Crandell | 52/172 |
| 7,073,292 | B1 * | 7/2006 | Minter et al. | 49/181 |
| 7,131,244 | B1 * | 11/2006 | Bradwell | 52/656.4 |
| 2005/0028458 | A1 * | 2/2005 | Rosskamp et al. | 52/172 |

* cited by examiner

*Primary Examiner*—Jeanette Chapman
*Assistant Examiner*—Jessica Laux
(74) *Attorney, Agent, or Firm*—Donald J. Ersler

(57) ABSTRACT

A removable window insulator preferably includes at least one pane, at least four frame members, at least four compressible seals and at least four draw members. At least one frame member is mitered on each one thereof. An edge seal strip is attached to an outer edge of each frame member. A single compressible seal is inserted between ends of two adjacent frame members. A single draw member is used to draw the adjacent frame members together. At least one cross member may be secured in an inner perimeter of the removable window insulator. Second and third embodiments of the removable window insulator are used to seal a double window. A fourth embodiment of the removable window insulator is used to seal a window with a partially curved perimeter.

19 Claims, 7 Drawing Sheets

REMOVABLE WINDOW INSULATOR

BACKGROUND OF THE INVENTION

1. Field of the Invention

The present invention relates generally to windows and more specially to a removable window insulator, which provides an air tight seal with a window frame.

2. Discussion of the Prior Art

The prior art provides numerous window inserts for insulating an interior of a home from outside air. Some of these prior art window inserts include U.S. Pat. No. 4,462,186 to Fuller, U.S. Pat. No. 4,486,990 to Bauch and U.S. Pat. No. 6,052,957 to Minnich. The Fuller patent discloses a self-adjusting window unit with corner assembly. The Fuller device permits continued adjustment of the frame while providing strength for the frame at the corners and while maintaining a fully insulated frame. The Bauch patent discloses a removable window insulation system. The Bauch device comprises a panel formed of a rigid foam insulation board dimensioned less than the interior casing dimensions of a window. The Minnich patent discloses a compressible insert. The Minnich device includes a sheet which is retained in an adjustable frame. However, to fully seal the compressible insert to a window frame, at least one fastener must be screwed through the adjustable frame into the window frame.

Accordingly, there is a clearly felt need in the art for a removable window insulator, which provides an air tight seal with a window frame; can be adjusted to fit into a window frame without modifying the window frame; and may be quickly removed once adjusted to fit the window.

SUMMARY OF THE INVENTION

The present invention provides a removable window insulator, which provides an air tight seal with a window frame. A removable window insulator preferably includes at least one pane, at least four frame members, at least four compressible seals and at least four draw members. Preferably, at least two vertical and two horizontal frame members are mitered on each end thereof. Each frame member includes a pane slot formed on an inside edge thereof that is sized to receive an outer perimeter of the at least one pane. An edge seal strip is attached to an outer edge of the frame member. A single compressible seal is inserted between adjacent mitered ends of two adjacent frame members. A draw member is used to draw the adjacent frame members together. A cross member may be secured in substantially a middle of the removable window insulator. However, two panes would be required instead of one. Two additional draw members and two compressible seals would be required to retain the cross member. The cross member allows adjustment of the removable window insulator in substantially a middle thereof.

A second embodiment of the removable window insulator is used to seal a double window. The second embodiment of the removable window insulator additionally includes a vertical cross member and a second horizontal cross member. One end of the vertical cross member is rigidly attached to the first horizontal frame member and the other end of the vertical cross member is rigidly attached to the second horizontal frame member. The two horizontal frame members are made long enough to accommodate the width of a double window. A first compressible seal is inserted between a first vertical frame member and the first cross member. One end of the first cross member is attached to the first vertical frame member with a draw member. The other end of the first cross member is rigidly attached to the vertical cross member. A second compressible seal is inserted between the second vertical frame member and one end of the second cross member. The one end of the second cross member is attached to the vertical frame member with a draw member. The other end of the second cross member is rigidly attached to the vertical cross member.

A third embodiment of the removable window insulator is used to seal a double window. The third embodiment of the removable window insulator includes placing two removable window insulators adjacent to each other. A cross member of a first removable window insulator includes a rigid connection between the other end of the cross member and a second vertical frame member of the first removable window insulator. A cross member of a second removable window insulator includes a rigid connection between the other end of the cross member and a first vertical frame member of the second removable window insulator.

A fourth embodiment of the removable window insulator is used to seal a window with a partially curved perimeter. The fourth embodiment of the removable window insulator includes two vertical frame members, a horizontal frame member and a curved frame member. A first compressible miter seal is inserted between one end of the first vertical frame member and one end of the horizontal frame member. A second compressible miter seal is inserted between the one end of the second vertical frame member and the other end of the horizontal frame member.

A first compressible seal is inserted between the one end of the curved frame member and the other end of the first vertical frame member. A second compressible seal is inserted between the junction of the other end of the curved frame member and the other end of the second vertical frame member. Preferably, a plurality of panes and cross members are retained within the frame members of the fourth embodiment of the removable window insulator.

Accordingly, it is an object of the present invention to provide a removable window insulator, which provides an air tight seal with a window frame.

It is a further object of the present invention to provide a removable window insulator, which can be adjusted to fit into a window frame without modifying the window frame.

Finally, it is another object of the present invention to provide a removable window insulator, which may be quickly removed, once adjusted to fit the window.

These and additional objects, advantages, features and benefits of the present invention will become apparent from the following specification.

DETAILED DESCRIPTION OF THE PREFERRED EMBODIMENTS

Figure 1:
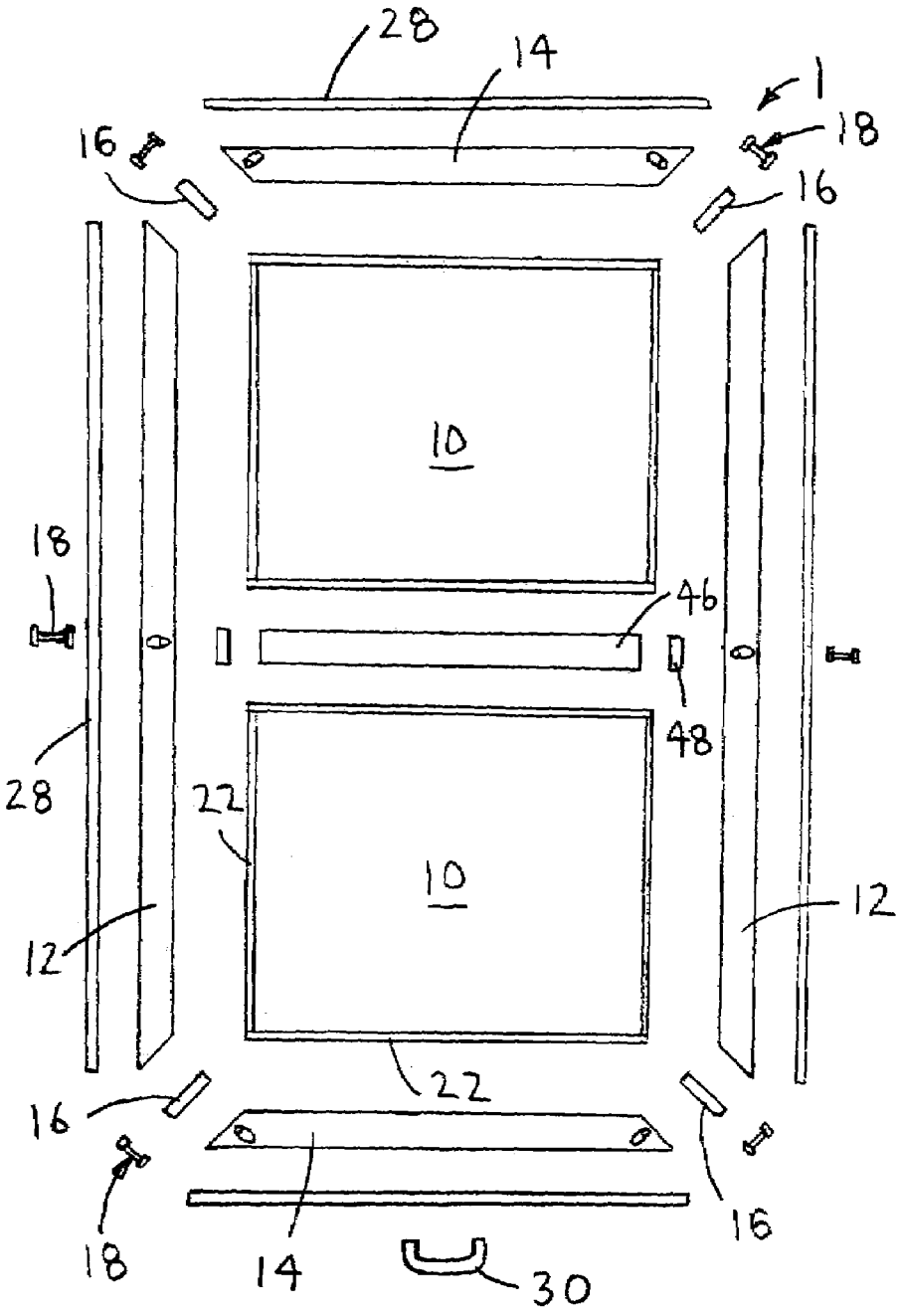
FIG. 1 is a partial front exploded view of a removable window insulator in accordance with the present invention.
Figure 2:
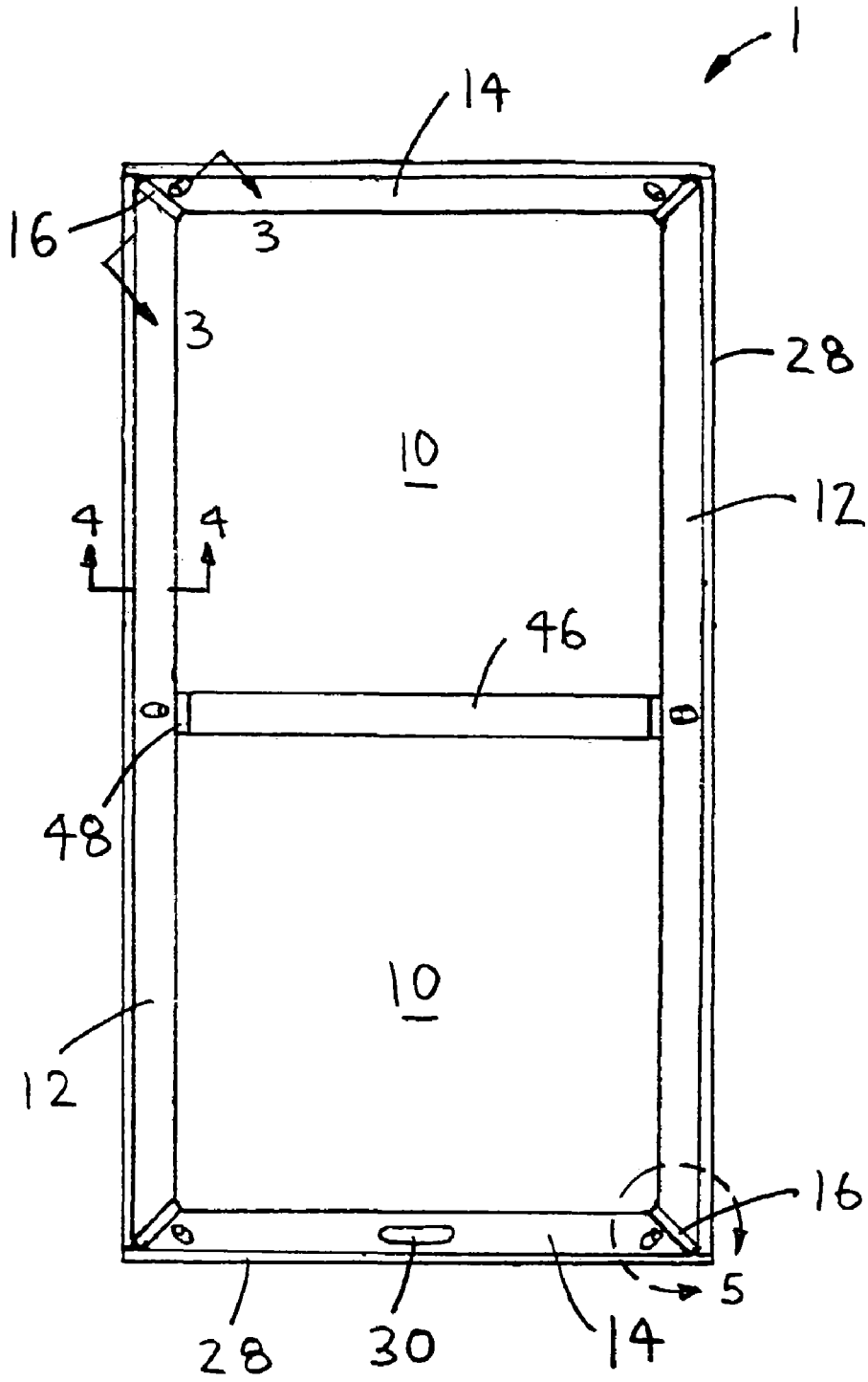
FIG. 2 is a front view of a removable window insulator in accordance with the present invention.
Figure 3:
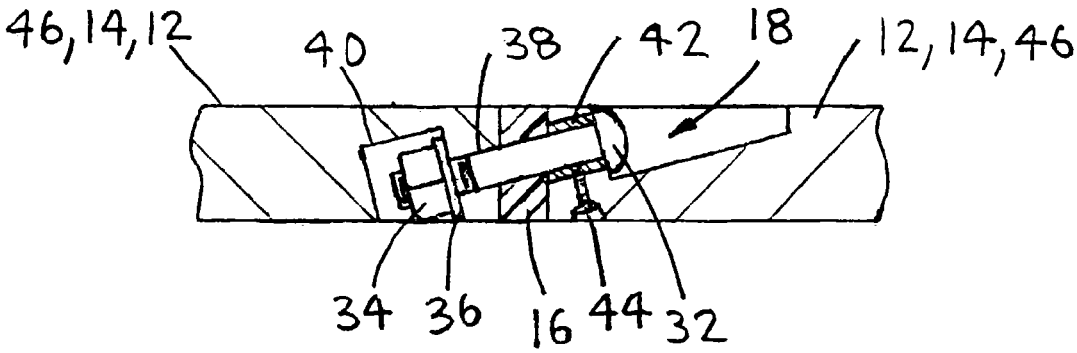
FIG. 3 is a cross sectional view of a draw member retaining two adjacent frame members of a removable window insulator in accordance with the present invention.
Figure 4:
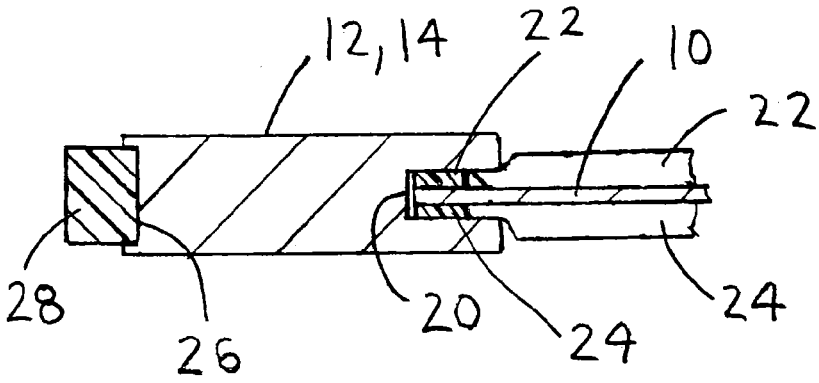
FIG. 4 is a cross sectional view of a frame member adjacent a pane of a removable window insulator in accordance with the present invention.
Figure 5:
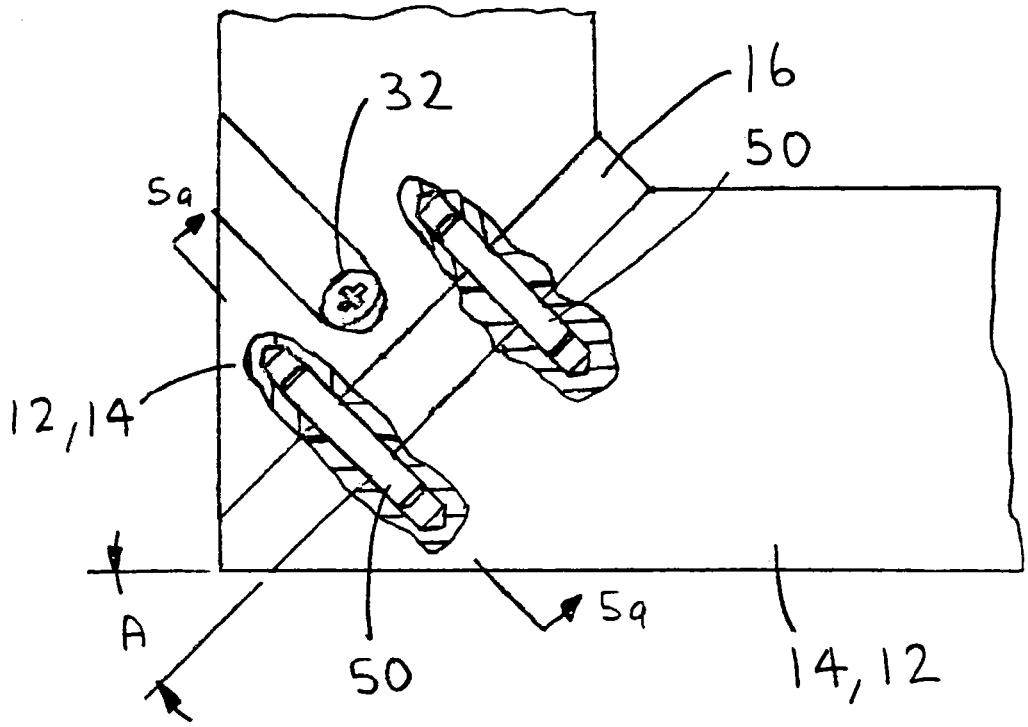
FIG. 5 is an enlarged front view of a junction between two adjacent members of a removable window insulator in accordance with the present invention.
Figure 5A:
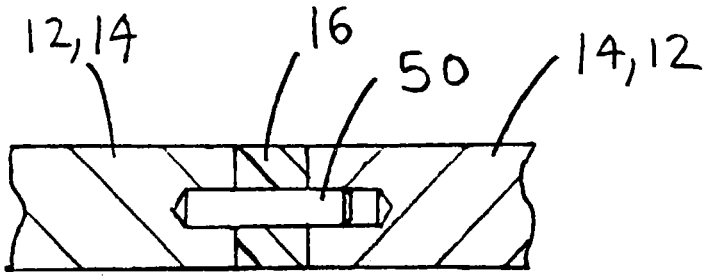
FIG. 5*a* is a cross sectional view cut through FIG. 5 in accordance with the present invention.

With reference now to the drawings, and particularly to FIG. 1, there is shown a partial exploded perspective view of a removable window insulator 1. With reference to FIGS. 2-5*a*, the removable window insulator 1 preferably includes at least one pane 10, at least two vertical frame members 12, at least two horizontal frame members 14, at least four compressible miter seals 16 and at least four draw members 18. Preferably, each pane 10 is fabricated from a clear plastic, such as plexiglass. Miter angle "A" preferably has a value of 45 degrees. However, other miter angle values may also be used. The miter angle "A" is formed on each end of the at least two vertical and horizontal frame members. Each frame member includes a pane slot 20 formed on an inside edge thereof that is sized to receive an outer perimeter of the at least one pane 10. The frame members have inside edges that form an inside edge perimeter. A top seal strip 22 is attached to a front peripheral edge of each pane 10 and a bottom seal strip 24 is attached to a bottom peripheral edge of each pane 10. The top and bottom seal strips provide a seal from a rear of the removable window insulator to a front thereof. However, other methods of sealing the pane to the inside edge of each frame member may also be used.

Each frame member preferably includes a groove 26 formed on an outside edge thereof that is sized to receive an edge seal strip 28. The edge seal strip 28 is retained in the groove 26 with any suitable attachment method, such as bonding. A single compressible miter seal 16 is inserted between adjacent mitered ends of two adjacent frame members. At least one handle 30 is preferably attached to a bottom horizontal frame member 14. Each draw member 18 preferably includes a fastener 32, a nut 34 and a washer 36. However, other types of draw members may also be used. A fastener hole 38 is formed through the compressible miter seal 16 and the two adjacent frame members to receive the fastener 32.

Each fastener hole 38 is terminated with a nut cavity 40. The nut cavity 40 is formed in an inside surface of one of the frame members to receive the nut 34. A wear sleeve 42 is preferably inserted into an entrance of the fastener hole 38. An anti-rotation screw 44 may be screwed into a side of the wear sleeve 42 to prevent rotation thereof. A head of the fastener 32 may originate in the vertical frame member as shown or in the horizontal frame member 14.

A cross member 46 may be secured in substantially a middle of the removable window insulator 1. Two panes 10 would be required instead of one. Two additional draw members 18 and two compressible seals 48 would be used to attach the cross member 46 to the two vertical frame members 12. The cross member 46 allows adjustment of the removable window insulator 1 in substantially a middle thereof. The head of the fastener 32 may originate in the vertical frame member 12 as shown or in the cross frame 46. A pair of dowel pins 50 are preferably used to align two adjacent frame members with each other. A slip fit hole is preferably formed in each adjacent frame member to receive each dowel pin 50. Each dowel pin 50 could also be pressed into one adjacent frame member. A clearance hole is formed through the compressible miter seal 16 to receive each dowel pin 50.

Figure 6:
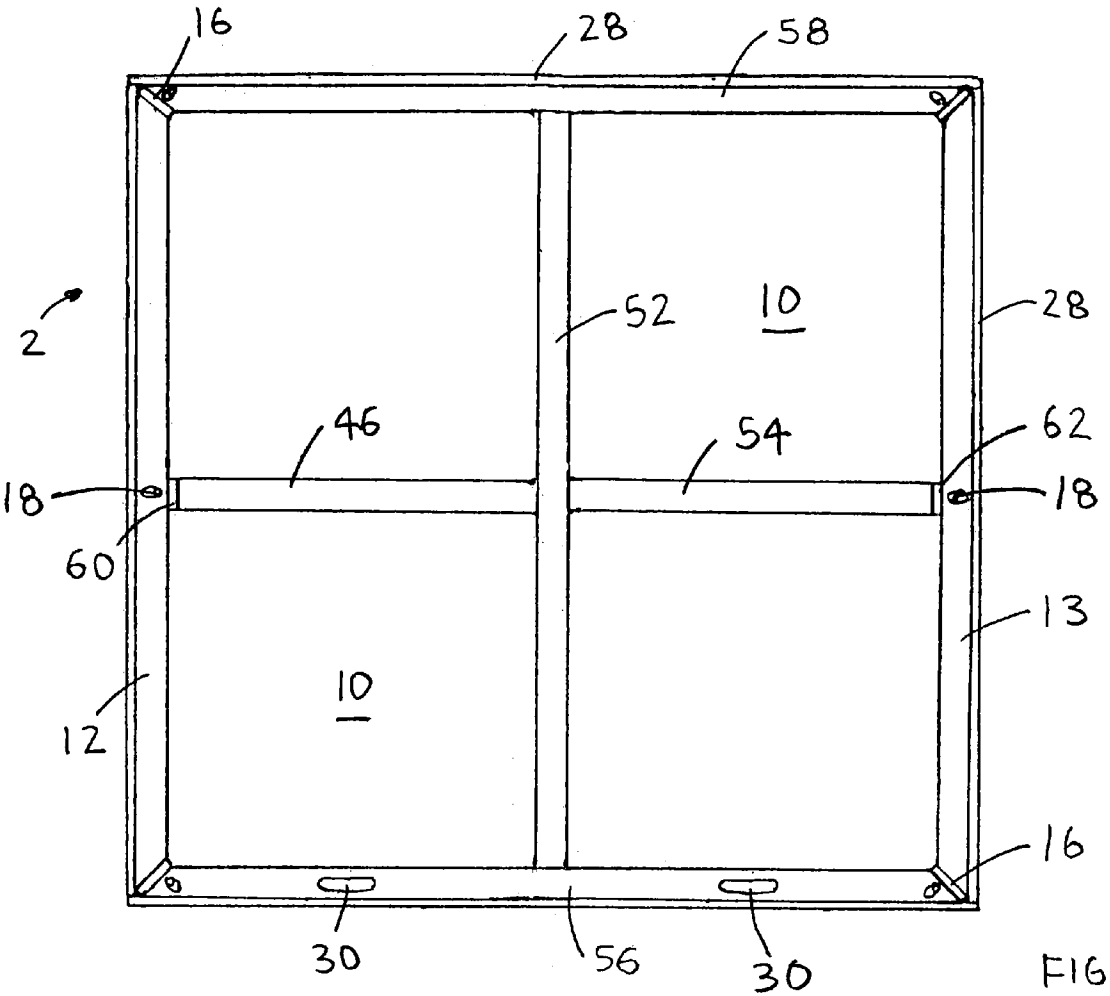
FIG. 6 is a front view of a second embodiment of a removable window insulator in accordance with the present invention.

With reference to FIG. 6, a second embodiment of the removable window insulator is used to seal a double window. The removable window insulator 2 additionally includes a vertical cross member 52 and a second horizontal cross member 54. One end of the vertical cross member 52 is rigidly attached to a first horizontal frame member 56 and the other end of the vertical cross member 52 is rigidly attached to a second horizontal frame member 58. The first and second horizontal frame members are made long enough to accommodate the width of a double window.

A first compressible seal 60 is inserted between the first vertical frame member 12 and one end of the first cross member 46. The one end of the first cross member 46 is secured to the first vertical frame member 12 with the draw member 18. The other end of the first cross member 46 is rigidly attached to the vertical cross member 52 with any suitable fastening method. A second compressible seal 62 is inserted between a second vertical frame member 13 and one end of the second cross member 54. The one end of the second cross member 54 is secured to the vertical cross member 52 with the draw member 18. The other end of the second cross member 54 is rigidly attached to the vertical cross member 52 with any suitable fastening method.

Figure 7:
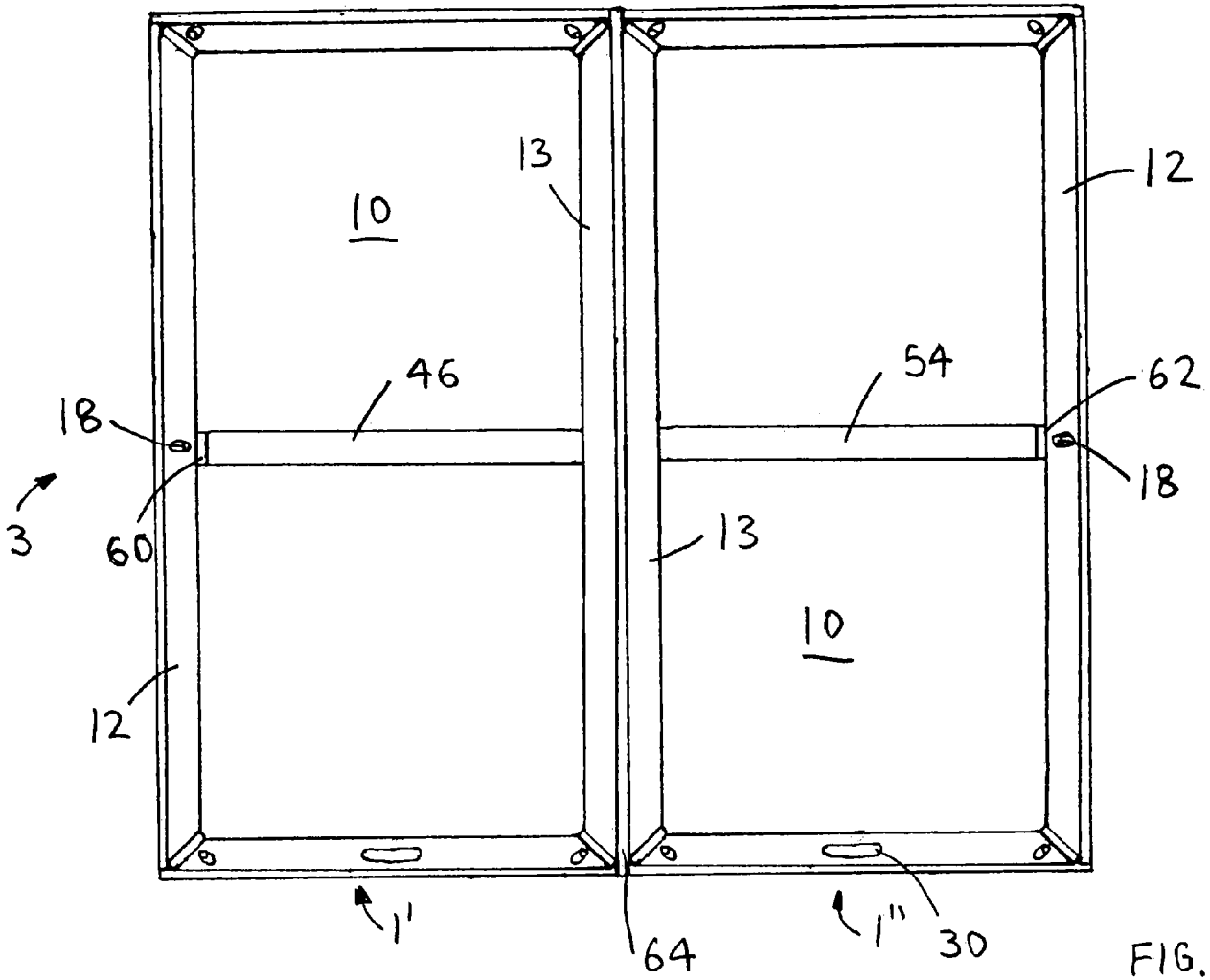
FIG. 7 is a front view of a third embodiment of a removable window insulator in accordance with the present invention.

With reference to FIG. 7, a third embodiment of the removable window insulator is used to seal a double window. The removable window insulator 3 additionally includes placing a first removable window insulator 1' adjacent a second removable insulator 1". The first compressible seal 60 is inserted between the first vertical frame member 12 and one end of the first cross member 46. The one end of the first cross member 46 is secured to the first vertical frame member 12 with the draw member 18. The other end of the first cross member 46 is rigidly attached to the second vertical frame member 13 with any suitable fastening method. The second compressible seal 62 is inserted between the first vertical frame member 12 and one end of the second cross member 54. The one end of the second cross member 54 is secured to the first vertical frame member 12 with the draw member 18. The other end of the second cross member 54 is rigidly attached to the second vertical frame member 13 with any suitable fastening method.

The second vertical frame member 13 of the first removable window insulator 1' may be attached to the second vertical frame member 13 of the second removable window insulator 1" with fasteners or any other suitable attachment method. The second vertical frame member 13 of the first removable window insulator 1' may be attached to the second vertical frame member 13 of the second removable window insulator 1" with at least one hinge. If the hinge is used, a vertical compressible seal 64 is retained between the second vertical frame members 13 of the first and second removable window insulators. The vertical compressible seal 64 may also be included, when fasteners are used to attach the first and second removable window insulators to each other.

Figure 8:
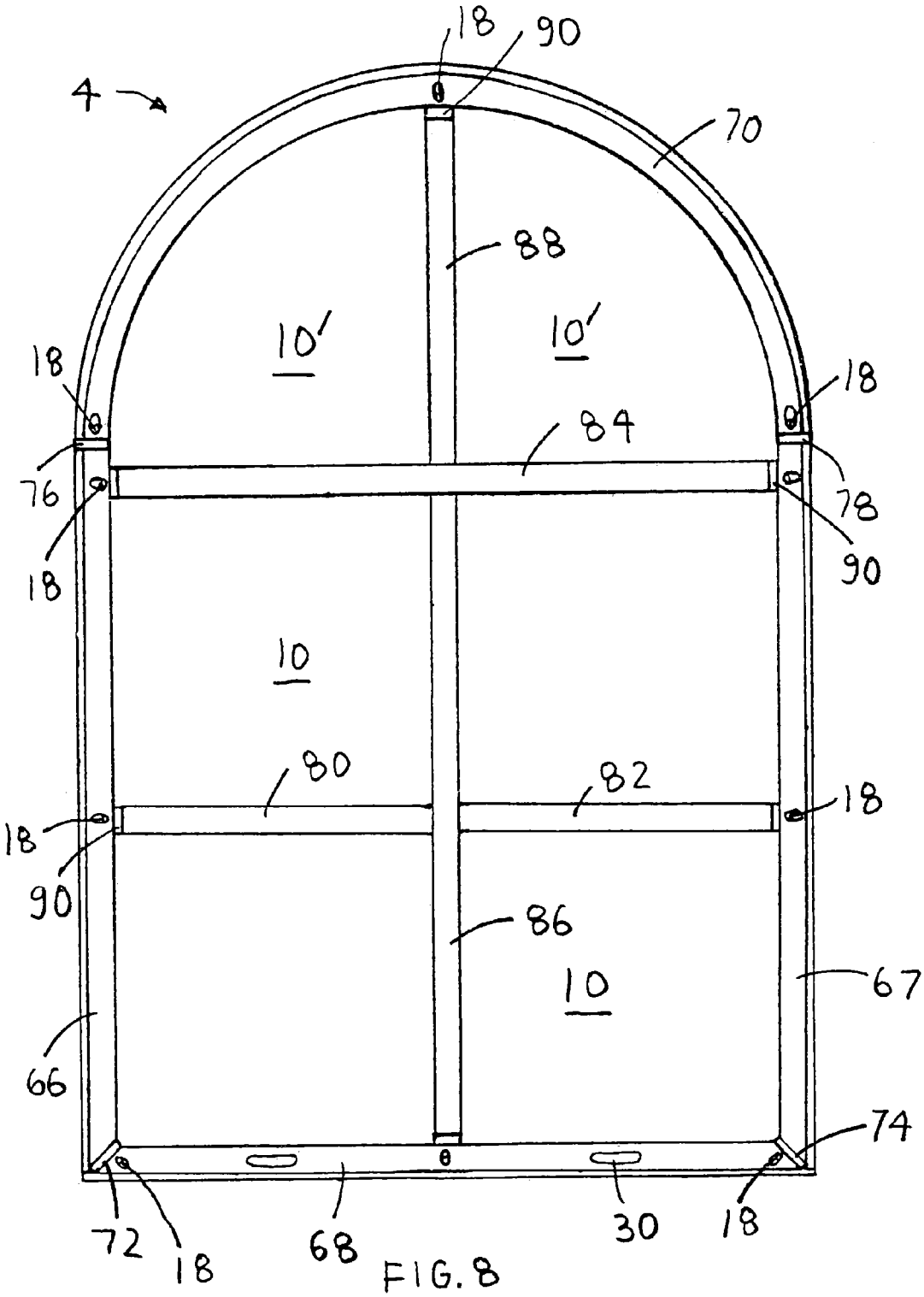
FIG. 8 is a front view of a fourth embodiment of a removable window insulator in accordance with the present invention.

With reference to FIG. 8, a fourth embodiment of the removable window insulator is used to seal a large window with a partially curved perimeter. The removable window insulator 4 includes a first vertical frame member 66, a second vertical frame member 67, a horizontal frame member 68 and a curved frame member 70. A first compressible miter seal 72 is inserted between one end of the first vertical frame member 66 and one end of the horizontal frame member 68. The one end of the first vertical frame 66 is secured to one end of the horizontal frame member 68 with the draw member 18.

A second compressible miter seal 74 is inserted between the junction of one end of the second vertical frame member 67 and the other end of the horizontal frame member 68. The one end of the second vertical frame 67 is secured to one end of the horizontal frame member 68 with the draw member 18. A first compressible seal 76 is inserted between one end of the curved frame member 70 and the other end of the first vertical frame member 66. The one end of the curved frame member 70 is secured to the other end of the first vertical frame member 66 with the draw member 18. A second compressible seal 78 is inserted between the other end of the curved frame member 70 and the other end of the second vertical frame member 67. The other end of the curved frame member 70 is secured to the other end of the second vertical frame member 67 with the draw member 18.

Preferably, the removable window insulator 4 further includes a first horizontal cross member 80, a second horizontal cross member 82, a third horizontal cross member 84, a first vertical cross member 86 and a second vertical cross member 88. A cross compressible seal 90 is inserted between one end of the first vertical cross member 86 and the first horizontal frame member 68. The one end of the first vertical cross member 86 is secured to the first horizontal frame member 68 with the draw member 18. A single cross compressible seal 90 is inserted between one end of the first horizontal cross member 80 and the first vertical frame member 66. The one end of the first horizontal cross member 80 is secured to the first vertical frame member 66 with the draw member 18. The other end of the first horizontal cross member 80 is rigidly attached to the first vertical cross member 86.

The cross compressible seal 90 is inserted between one end of the second horizontal cross member 82 and the second vertical frame member 67. The one end of the second horizontal cross member 82 is secured to the second vertical frame member 67 with the draw member 18. The other end of the second horizontal cross member 82 is rigidly attached to the first vertical cross member 86. A single cross compressible seal 90 is inserted between one end of the third horizontal cross member 84 and the first vertical frame member 66. The one end of the third horizontal cross member 84 is secured to the first vertical frame member 66 with the draw member 18. The cross compressible seal 90 is inserted between the other end of the third horizontal cross member 84 and the second vertical frame member 67. The other end of the third horizontal cross member 84 is secured to the second vertical frame member 67 with the draw member 18.

The other end of the first vertical cross member 86 is rigidly attached to substantially a middle of the third horizontal cross member 84. One end of the second vertical cross member 88 is rigidly attached to substantially a middle of the third horizontal cross member 84. The cross compressible seal 90 is inserted between the other end of the second vertical cross member 88 and the curved frame member 70. The second vertical cross member 88 is secured to the curved frame member 70 with the draw member 18.

Assembly details shown in FIGS. 1-5*a* of the removable window insulator 1 apply to the removable window insulators 2-4. The removable window insulator 1-4 should not be limited to installation in windows only, but should include skylights, sliding doors and any other appropriate application.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of forming a removable window insulator, comprising the steps of:

providing at least four frame members;

mitering each end of at least one of said at least four frame members;

inserting a compressible seal between the ends of two adjacent frame members before securing said two adjacent frame members to each other;

sealing at least one pane to an inside edge perimeter of said at least four frame members;

applying a sealing strip to an outside perimeter of said at least four frame members; and retaining at least one cross member within said inside edge perimeter of said at least four frame members, inserting a single said compressible seal between an end of one of said at least one cross member and one of said at least four frame members.

2. The method of forming a removable window insulator of claim 1, further comprising the step of:

securing said end of one of said at least one cross member to one of said at least four frame members with a cross draw member.

3. The method of forming a removable window insulator of claim 1, further comprising the step of:

securing said two adjacent frame members to each other with a draw member.

4. The method of forming a removable window insulator of claim 1, further comprising the steps of:

applying a top seal strip to a front peripheral edge of each one of said at least one pane; and applying a bottom seal strip to a bottom peripheral edge of each one of said at least one pane.

5. The method of forming a removable window insulator of claim 1, further comprising the steps of:

at least one frame member being curved.

6. The method of forming a removable window insulator of claim 1, further comprising the steps of:

adjusting at least one said draw member to fit said removable window insulator into a window frame.

7. A method of forming a removable window insulator for insertion into a window frame, comprising the steps of:

providing at least four frame members;

mitering each end of at least one of said at least four frame members;

inserting a compressible seal between the ends of two adjacent frame members before securing said two adjacent frame members to each other with a draw member;

sealing at least one pane to an inside edge perimeter of said at least four frame members;

applying a sealing strip to an outside perimeter of said at least four frame members; and adjusting at least one said draw member to change a length of said outside perimeter of said removable window insulator to fit into a window frame.

8. The method of forming a removable window insulator of claim 7, further comprising the step of:

retaining at least one cross member within said inside edge perimeter of said at least four frame members.

9. The method of forming a removable window insulator of claim 8, further comprising the step of:

inserting a single compressible seal between an end of one of said at least one cross member and one of said at least four frame members.

10. The method of forming a removable window insulator of claim 9, further comprising the step of:

securing said end of one of said at least one cross member to one of said at least four frame members with a cross draw member.

11. The method of forming a removable window insulator of claim 7, further comprising the steps of:

applying a top seal strip to a front peripheral edge of each one of said at least one pane; and applying a bottom seal strip to a bottom peripheral edge of each one of said at least one pane.

12. The method of forming a removable window insulator of claim 7, further comprising the steps of:

at least one frame member being curved.

13. A method of forming a removable window insulator, comprising the steps of:

providing at least four frame members;

mitering each end of at least one of said at least four frame members;

inserting a compressible seal between the ends of two adjacent frame members before securing said two adjacent frame members to each other;

sealing at least one pane to an inside edge perimeter of said at least four frame members;

applying a sealing strip to an outside perimeter of said at least four frame members; and adjusting at least one draw member to change a length of said outside perimeter of said removable window insulator to fit into a window frame.

14. The method of forming a removable window insulator of claim 13, further comprising the step of:

retaining at least one cross member within said inside edge perimeter of said at least four frame members.

15. The method of forming a removable window insulator of claim 14, further comprising the step of:

inserting a single said compressible seal between an end of one of said at least one cross member and one of said at least four frame members.

16. The method of forming a removable window insulator of claim 15, further comprising the step of:

securing said end of one of said at least one cross member to one of said at least four frame members with a cross draw member.

17. The method of forming a removable window insulator of claim 13, further comprising the step of:

securing said two adjacent frame members to each other with said at least one draw member.

18. The method of forming a removable window insulator of claim 13, further comprising the steps of:

applying a top seal strip to a front peripheral edge of each one of said at least one pane; and applying a bottom seal strip to a bottom peripheral edge of each one of said at least one pane.

19. The method of forming a removable window insulator of claim 13, further comprising the steps of:

at least one frame member being curved.

* * * * *